United States Patent [19]

Ryan

[11] Patent Number: 5,024,696

[45] Date of Patent: Jun. 18, 1991

[54] APPARATUS AND METHOD FOR DEGASSING MOLTEN METAL

[75] Inventor: Thomas J. Ryan, St. Clairsville, Ohio

[73] Assignee: Alusuisse-Lonza Services Ltd., Zurich, Switzerland

[21] Appl. No.: 556,308

[22] Filed: Jul. 23, 1990

[51] Int. Cl.[5] ..... C22B 9/05; F27D 3/14; F27D 1/16

[52] U.S. Cl. ..... 75/708; 266/217; 264/30; 75/680; 75/681

[58] Field of Search ..... 266/215, 218, 219, 220, 266/233, 227, 901; 264/30; 75/680, 681, 708, 682, 683, 412

[56] References Cited

U.S. PATENT DOCUMENTS 4,572,485 2/1986 Engelberg et al. ..... 266/227
4,744,545 5/1988 McDonald ..... 266/233

*Primary Examiner*—Melvyn J. Andrews
*Attorney, Agent, or Firm*—Bachman & LaPointe

[57] ABSTRACT

An improved apparatus and method of the inline degassing of the molten metal employing a fluxing gas.

11 Claims, 3 Drawing Sheets

APPARATUS AND METHOD FOR DEGASSING MOLTEN METAL

BACKGROUND OF THE INVENTION

The present invention relates to the treatment of liquids with gases and more particularly to the degassing of molten metal. Molten metal, particularly molten aluminum in practice, generally contains entrained and dissolved impurities both gaseous and solid which are deleterious to the final cast product. These impurities may affect the final cast product after the molten metal is solidified whereby processing may be hampered or the final product may be less ductile or have poor finishing and anodizing characteristics. The impurities may originate from several sources. For example, the impurities may include metallic impurities such as alkaline and alkaline earth metals and dissolved hydrogen gas and occluded surface oxide films which have become broken up and are entrained in the molten metal. In addition, inclusions may originate as insoluble impurities such as carbides, borides and others or eroded furnace and trough refractories.

One process for removing gaseous impurities from molten metals is by degassing. The physical process involves injecting a fluxing gas into the melt. The hydrogen enters the purged gas bubbles by diffusing through the melt to the bubble where it adheres to the bubble surface and is adsorbed into the bubble itself. The hydrogen is then carried out of the melt by the bubble.

While such treatments have generally been successful in reducing the occurrence of such defects to satisfactory levels, they have been found to be inefficient and/or uneconomical. Conventionally conducted gas fluxing processes such as general hearth fluxing have involved the introduction of the fluxing gas to a holding furnace containing a quantity of molten metal. This procedure requires that the molten metal be held in the furnace for significant time while the fluxing gas is circulated so that the metal being treated would remain constant and treatment could take place. This procedure has many drawbacks, among them, the reduced efficiency and increased cost resulting from the prolonged idleness of the furnace during the fluxing operation and, more importantly, the lack of efficiency of the fluxing operation due to poor coverage of the molten metal by the fluxing gas which is attributable to the large bubble size and poor bubble dispersion within the melt.

As an alternative to the batch-type fluxing operations employed as aforesaid, certain fluxing operations have been employed in an inline manner, that is, the operation and associated apparatus were located outside the melting or holding furnace and often between the melting furnace and either the holding furnace or the holding furnace and the casting station. The inline approach helped to alleviate the inefficiency and high cost resulting from furnace idleness when batch fluxing but was not successful in improving the efficiency of the degassing operation itself, in that the large size of the units and the undesirably large quantities of fluxing gas required per unit of molten metal were both costly and detrimental to air purity.

A typical inline gas fluxing technique is disclosed in U.S. Pat. No. 3,737,304. In the aforenoted patent, a bed of "stones" is positioned in a housing through which the molten metal will pass. A fluxing gas is introduced beneath the bed and flows up through the spaces between the stones in counter flow relationship with the molten metal. The use of a bed of porous "stones" has an inherent disadvantage. The fact that the stones have their pores so close together results in the bubbles passing through the stones coalescing and thus creating a relatively small number of large bubbles rather than a large number of small bubbles. The net effect of the bubbles coalescing is to reduce the surface area of bubble onto which the hydrogen can be adsorbed thus resulting in low degassing efficiency.

One improved method and apparatus for the inline degassing of molten metal is disclosed in U.S. Pat. No. 4,052,198 to Yarwood et al. and assigned to the assignee of the present invention. The disclosure teaches an improvement in the degassing of molten metal using an apparatus which employs a pair of sequentially placed, removable filter-type elements and at least one fluxing gas inlet positioned therebetween. The fluxing gas is introduced into the melt through the inlet and flows through the first of said plates in countercurrent contact with the melt. The filter plate serves to break up the fluxing gas into a fine dispersion to insure extensive contact with the melt. The filter plates employed are made of porous ceramic foam materials which are useful for the filtration of molten metal for a variety of reasons included among which are their excellent filtration efficiencies resulting from their uniform controllable pore size, low cost as well as ease of use and replaceability.

While the aforenoted U.S. Pat. No. 4,052,198 offers significant improvements over those inline gas fluxing techniques previously known in the art, a number of problems have been encountered. It is desirable for economic advantages and increased productivity to have degassing systems which can treat molten metal continuously at a rate commensurate with the casting practices. While some improvement in the quantity of molten metal which can be treated has been achieved by using a smaller system such as that disclosed in U.S. Pat. No. 4,052,198 which utilizes ceramic filters and countercurrent gas flow, such system has been found to have a limited effectiveness in the quantity of molten metal which can be treated due to the large pressure drops encountered in the simultaneous countercurrent flow of gas and metal through the filter body. As a result of the large pressure drop, a large head of molten metal is developed upstream of the filter element thus requiring either an increase in size of the transfer passageway upstream of the filter element or a decrease in the rate of feeding the molten metal to the treatment unit. In addition to the limited effectiveness of the quantity of molten metal which can be treated in the aforenoted U.S. patent, it has been found that the efficiency of the degassing process leaves much to be desired since it has been found that the fluxing gas bubbles tend to coalesce thereby limiting the efficiency of the kinetics of the adsorption reaction.

The method and apparatus for inline gas fluxing is disclosed in U.S. Pat. No. 4,177,066. The disclosure teaches an improvement in the degassing of molten metal, especially aluminum using an apparatus which employs a swirling tank reactor. The swirling tank reactor is in the form of a substantially cylindrical chamber and is characterized by having a liquid inlet at the top thereof and at least one gas inlet at the bottom of said substantially cylindrical chamber wherein at least either the liquid inlet or the gas inlet is positioned with respect to the wall of the cylindrical chamber of tangentially introducing either liquid or gas such that the liquid swirlingly flows from said liquid inlet to a liquid outlet. In a preferred embodiment for the degassing and filtration of molten metal, a filter-type medium is positioned beneath said molten metal inlet to filter the molten metal prior to delivering the same to a casting station. Dissolved gases and non-metallic inclusions are thereby abstracted and removed from the melt.

FIG. 1 illustrates the prior art apparatus which is used inline between a melting furnace and a casting station. Molten metal is delivered from the casting station to the swirling tank reactor 10 via tangential inlet 12 and the metal swirling flows downwardly through the reactor 10 to outlet 14. From outlet 14, the molten metal flows through cross over passages 16 and 18 and into the filter bowl 20. The filtered molten metal is delivered via inline 22 to the casting station. It has been found in practice that metal freeze up tends to occur in the cross over passages 16 and 18. Naturally, it would be highly desirable to be able to feed the molten metal from the reactor 10 to the filter bowl 20 in a more direct manner so as to eliminate any possibility of metal freeze out.

Accordingly, it is the principle object of the present invention to provide an apparatus for degassing molten metal which is useful inline between a melting furnace and a casting station.

It is a further object of the present invention to provide a method for degassing molten metal inline between a melting furnace and a casting station.

It is a still further principle object of the present invention to provide a method for retrofitting prior art degassing apparatuses of the swirling tank variety. Further objects and advantages of the present invention will appear hereinbelow.

SUMMARY OF THE INVENTION

In accordance with the present invention, the foregoing objects and advantages are readily obtained. The present invention is drawn to an improved method and apparatus for treating molten metal and, more particularly, for treating molten metal inline between a melting furnace and a casting station wherein metal freeze up is eliminated.

In accordance with the preferred embodiment of the present invention, the apparatus for use in degassing molten metal includes a reaction chamber having an elongated side wall portion about a central axis. A tangential inlet is provided in the sidewall of the reactor chamber for introducing molten metal and an outlet is provided for delivering molten metal from the reaction chamber to a casting station. A plurality of fluxing gas inlet nozzles inject fluxing gas into the molten metal as it passes from the tangential inlet to the outlet of the reaction chamber. In accordance with the preferred embodiment of the apparatus of the present invention, a portion of the elongated sidewall of the reaction chamber is in the form of a hollow tube-like section which forms the molten metal outlet for passing metal from the reaction chamber toward the casting station. The hollow tube-like section has an inlet located at a first height below the tangential inlet and an outlet located at a second height which is above the first height. By employing such an arrangement, molten metal in the tube-like section passes upwardly in heat exchange relationship with molten metal in the reaction chamber as the molten metal flows through the reaction chamber and the hollow tube-like section. In accordance with a particular feature of the present invention, the hollow tube-like section is formed of a thermally conductive material which is non-reactive to the metal being treated. The present invention further contemplates a method for degassing molten metal employing an apparatus as aforesaid.

In accordance with the present invention, the embodiment of the degassing apparatus as set forth above is produced by a further method of the present invention which includes retrofitting those preexisting prior art degassing apparatus as shown in FIG. 1 and described above in the Background of the Invention. In accordance with the method of the present invention, the method for retrofitting preexisting swirling tank reactors comprises the steps of removing a portion of the elongated sidewall of the reactor chamber and positioning and sealing in the vacated sidewall area the elongated hollow tube-like member which is formed of a thermally conductive material which is non-reactive to the metal being treated.

In accordance with the present invention, an improved apparatus for degassing molten metal includes a swirling tank reactor wherein the molten metal inlet is provided below the molten metal outlet and the molten metal is allowed to swirlingly flow upwardly through the reactor chamber through an outlet which feeds directly to a filter bowl chamber and inline degassing system.

The apparatus and method of the present invention as well as the method for retrofitting preexisting apparatuses overcomes the problems noted above with regard to prior art inline degassing apparatuses used between melting furnaces and casting stations. The apparatus of the present invention eliminate lengthy cross-over passages and insure a heat exchange relationship which eliminates any problem of metal freeze up.

DETAILED DESCRIPTION

Figure 1:
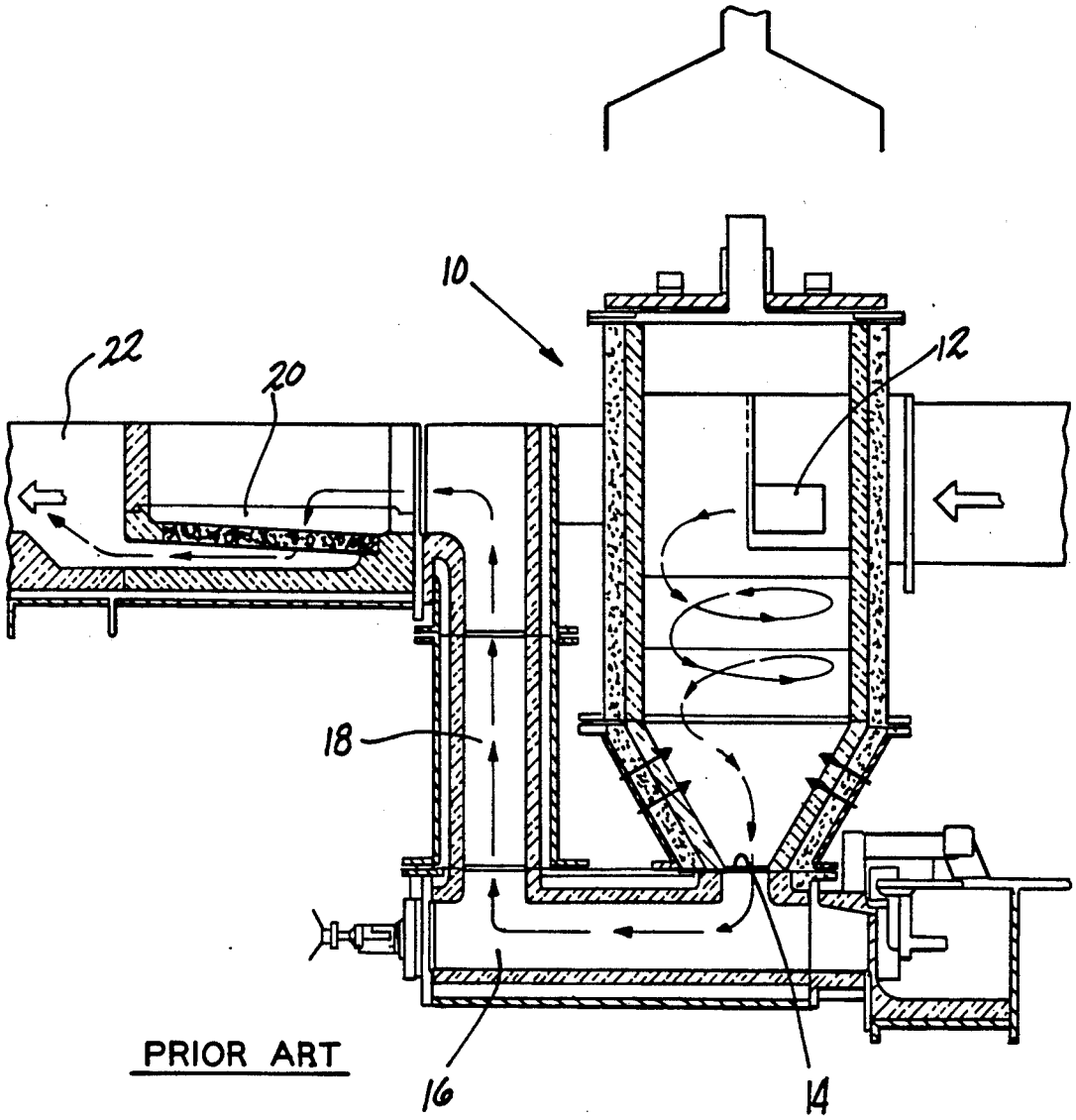
PRIOR ART FIG-1
FIG. 1 is a cross-sectional view of a prior art degassing apparatus employed inline for the treatment of molten metal as the molten metal passes from a melting furnace to a casting station.
Figure 2:
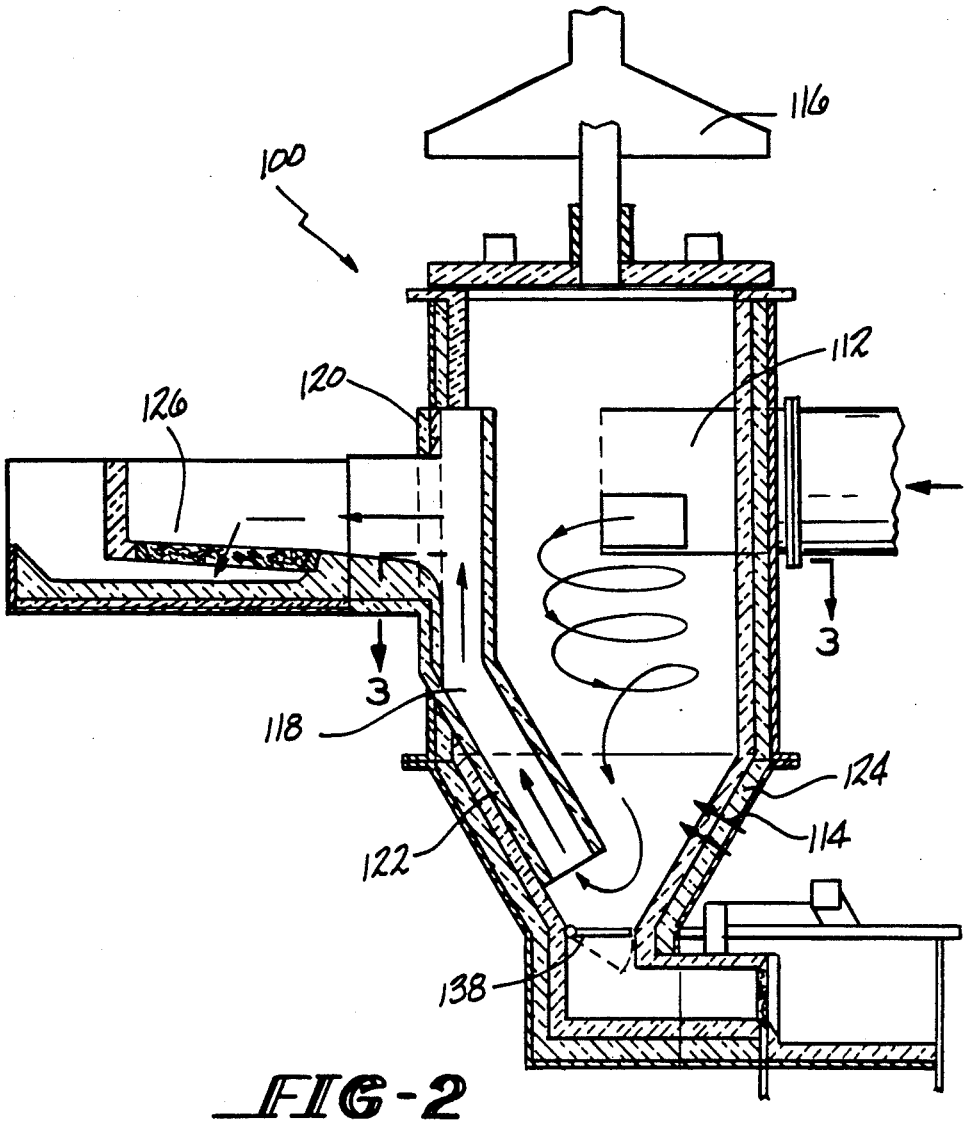
FIG. 2 is a sectional view similar to FIG. 1 showing the improved degassing apparatus of the present invention.
Figure 3:
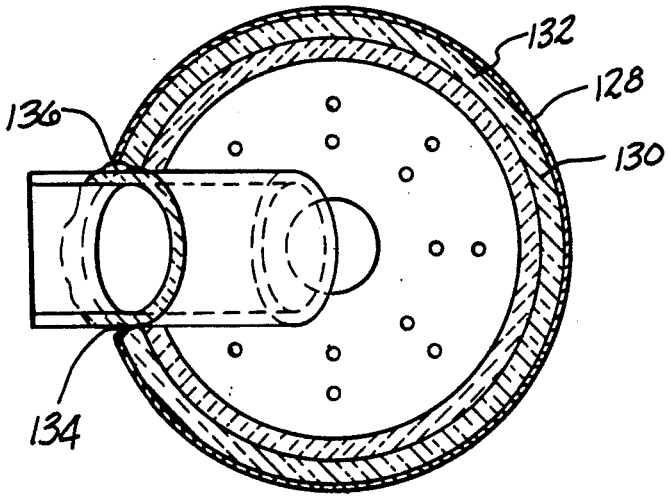
FIG. 3 is a sectional top view of an apparatus in accordance with the present invention taken along lines 3—3 of FIG. 2.

With reference to FIGS. 2 and 3, a first embodiment of the present invention is illustrated in location inline in a metal transfer system between a melting furnace and a casting station. The embodiment of the apparatus of the present invention as illustrated in FIGS. 2 and 3 represents a retrofit unit of a prior art degassing apparatus as illustrated in FIG. 1.

In accordance with the apparatus of the present invention 100 as illustrated in FIG. 2, a molten metal inlet 112 is provided for tangentially introducing molten metal into the reaction chamber such that the molten metal swirlingly flows from the inlet down through the reaction chamber. A plurality of the fluxing gas nozzles 114 are provided for introducing a fluxing gas into the reaction chamber so that the fluxing gas passes upward and countercurrent flows to the molten metal so as to degas same. The fluxing gas may be any of a wide variety of well-known fluxing gases as disclosed in U.S. Pat. No. 4,177,066 and the other patents referred to in the Background of the Invention of the instant application. These gases include chlorine and other halogenated gaseous materials, carbon monoxide as well as certain inert gas mixtures, nitrogen, argon, helium or the like. In the apparatus of the present invention as illustrated in FIG. 2, these gas mixtures are used in conjuction with an exhaust vent 116 for collecting any noxious gases such as chlorine and the like.

In accordance with a particular feature of the present invention, the outlet from the reactor chamber is formed at least in part in a portion of the sidewall of the reaction chamber. As can be seen in FIG. 2, the tube-like outlet 118 comprises a first section 120 which forms part of the sidewall portion and a second section 122 which rests on the converging part 124 of the reactor 120. As can be seen in FIG. 3, the tube-like section 118 is sealed in the sidewall portion via suitable sealing means such as ceramic cements and pastes and refractory mortars. Particularly suitable sealing materials include the following: boron nitride, aluminum oxide paste; silicon carbide paste; and phosphate bonded silicon carbide mortar. In accordance with a particular feature of the present invention, the hollow tube-like section 118 is formed of a thermally conductive material which is non-reactive to the metal being treated. A suitable material from which the tube-like structure can be formed includes silicon carbide; graphite; nitride bonded silicon carbide; aluminum nitride; and silicon nitride bonded silicon carbide, with silicon carbide being preferred. As the outlet tube 118 is located within the reaction chamber of the apparatus, the molten metal passing upwardly through the outlet of the tube-like structure to the filter bowl 126 passes in heat exchange relationship with the hot molten metal being introduced in the reaction chamber of apparatus 100 from the melting furnace. By such an arrangement, any likelihood of freeze up of the metal in the tube-like outlet section 118 is avoided.

In accordance with the present invention, existing degassing apparatuses may be retrofitted with the hollow tube-like outlet member as described above. With reference to FIGS. 1–3, the elongated sidewall portions of the reactor comprises an outer metal casing 128 and intermediate insulating layer 130 and a ceramic interior wall 132 which may be formed of, for example, fused silica. In order to retrofit preexisting units as shown in FIG. 1, a portion of the elongated sidewall is removed along a length thereof substantially parallel to the central axis of the apparatus thereby defining a channel 134. The elongated tube-like member is positioned within the channel as shown in FIGS. 2 and 3 and is sealed therein by means of a sealing material 136 selected from those set forth above. The bottom of the reactor 100 is then sealed off by a flap valve 138 which can be selectively moved between a closed and an open position for draining and cleaning the reactor.

Figure 4:
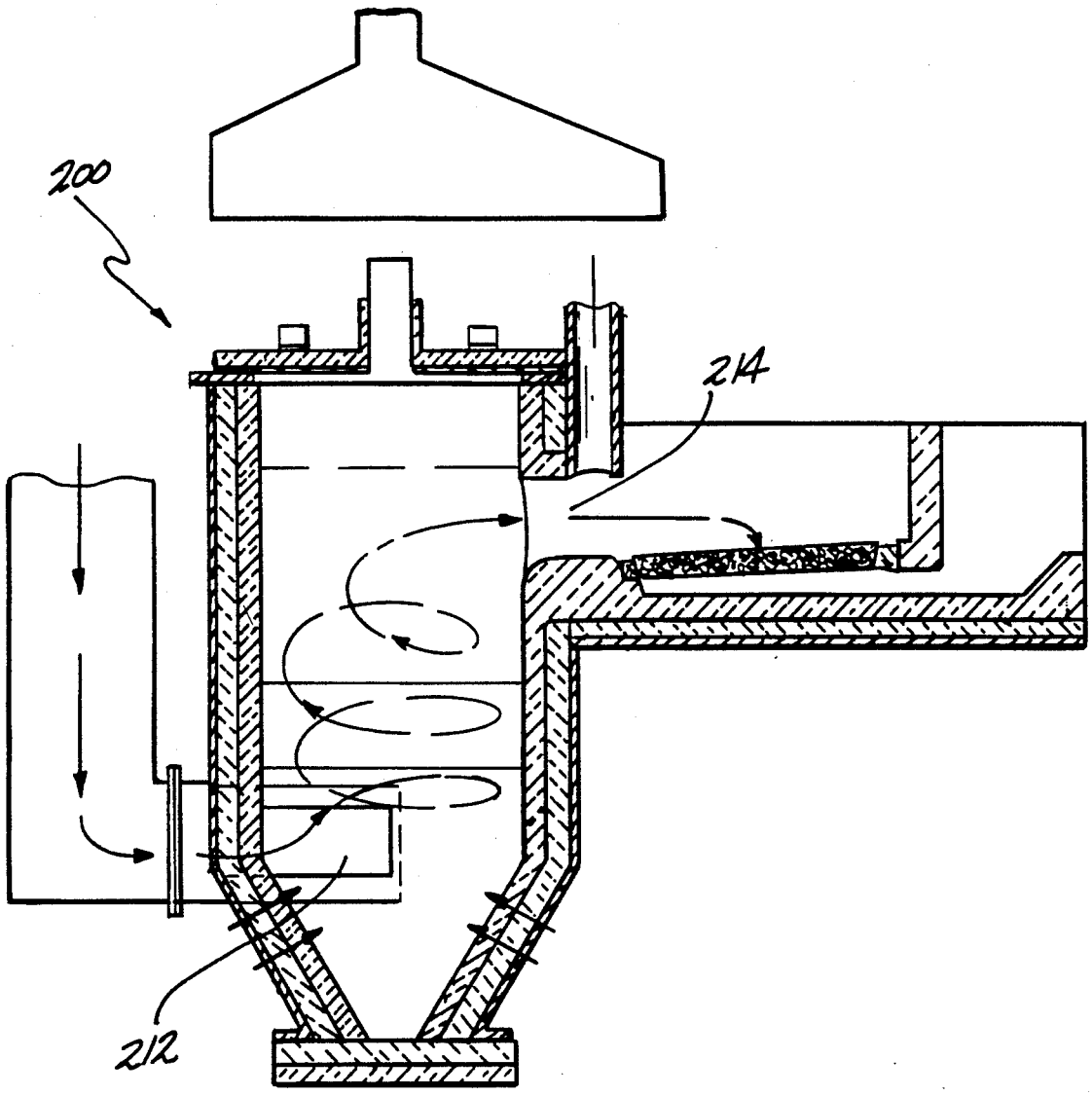
FIG. 4 is a further embodiment of an improved apparatus in accordance with the present invention.

With reference to FIG. 4 a further embodiment of the present invention is illustrated wherein the reactor 200 is provided with a tangential inlet 212 which is located below the outlet 214 of the reactor. It has surprisingly been found that the molten metal swirlingly flows through the reactor even when the molten metal is tangentially introduced at a lower level which requires the molten metal to flow upward through the reactor to the outlet. By providing an arrangement as shown in FIG. 4, the necessity of a cross over is eliminated.

As can be seen from the foregoing, the apparatus of the present invention overcomes the problem heretofore experienced with prior art degassing apparatuses when used inline with a melting furnace and a casting station.

It is to be understood that the invention is not limited to the illustrations described and shown herein, which are deemed to be merely illustrative of the best modes of carrying out the invention, and which are susceptible of modifications of form, size, arrangement of parts and details of operation. The invention rather is intended to encompass all such modifications which are within its spirit and scope as defined by the claims.

What is claimed is:

1. In an apparatus for use in degassing molten metal including a reaction chamber having an elongated sidewall portion and a central axis, a tangential inlet for the introduction of molten metal and a metal outlet for delivering molten metal to a casting station, and a plurality of fluxing gas nozzle inlets for passing fluxing gas through the molten metal as the molten metal passes through said reaction chamber from the inlet to the outlet, the improvement which comprises a portion of said elongated sidewall portion includes a hollow tube-like section forming said molten metal outlet, said hollow tube-like section having an inlet at a first height below said molten metal inlet and an outlet at a second height above said first height such that said molten metal in said hollow tube-like section passes in a heat exchange relationship with said molten metal in said reaction chamber as metal flows through said reaction chamber and said hollow tube-like section.

2. An apparatus according to claim 1 wherein said first height is below said plurality of fluxing gas inlets.

3. An apparatus according to claim 2 wherein said hollow tube-like section is formed of a thermally conductive material which is non-reactive to the metal being treated.

4. An apparatus according to claim 3 wherein said material is selected from the group consisting of graphite; silicon carbide; nitride bonded silicon carbide; aluminum nitride; and silicon nitride bonded silicon carbide.

5. An apparatus according to claim 3 wherein said material is silicon carbide.

6. An apparatus according to claim 1 wherein said reaction chamber includes a drain valve for cleaning out said chamber.

7. An apparatus according to claim 1 wherein said elongated sidewall portion comprises a first substantially cylindrical part and a second downwardly converging part below said first part and wherein said hollow tube-like section includes (1) a first section which forms part of said first part of said elongated sidewall portion and (2) a second section which abuts said second part of said elongated sidewall portion.

8. A method for degassing molten metal in a reaction chamber having an elongated sidewall portion wherein molten metal is tangentially introduced into said chamber from an inlet provided at a first height and contacted with a fluxing gas injected into said reaction chamber from nozzle inlets and said molten metal swirlingly flows from said inlet to an outlet, the improvement which comprises forming a portion of said elongated sidewall portion of a hollow tube-like section having a molten metal inlet at a second height below said first height for recessing molten metal from the reactor and a molten metal outlet as a third height above said second height and passing said molten metal from said reaction chamber through said hollow tube-like section from its inlet to its outlet in heat exchange relationship with said metal swirlingly flowing in said reaction chamber.

9. A method according to claim 8 including positioning the inlet to said hollow tube-like section below the nozzle inlets from the fluxing gas.

10. An apparatus for degassing molten metal which comprises:

chamber means having an elongated sidewall portion and a central axis;

inlet means at a first height for tangentially introducing said molten metal into said chamber;

outlet means at a second height above said first height for removing said molten metal from said chamber;

at least two fluxing gas inlet means located below said first height for introducing said fluxing gas into said chamber; and wherein said molten metal introduced into said chamber swirlingly flows from said molten metal inlet towards said molten metal outlet as said fluxing gas percolates up through said molten metal.

11. A method for retrofitting an apparatus for degassing molten metal characterized by a reaction chamber having an elongated sidewall portion and a central axis, a tangential inlet for the introduction of molten metal and a metal outlet for delivering molten metal to a casting station, and a plurality of fluxing gas nozzle inlets for passing fluxing gas through the molten metal as the molten metal passes through said reaction chamber from the inlet to the outlet, comprising the steps of (1) providing an elongated, hollow tube-like member having a maximum width X, (2) removing a portion of the elongated sidewall of said apparatus along a length thereof substantially parallel to the central axis so as to define a channel (3) positioning said elongated hollow tube-like member within said channel, and (4) sealing said tube-like member in said channel to said elongated sidewall so as to form a continuous sidewall.

* * * * *